US010765241B2

(12) United States Patent
Royer

(10) Patent No.: US 10,765,241 B2
(45) Date of Patent: Sep. 8, 2020

(54) TABLEWARE STAND

(71) Applicant: PLATE LIFTER, LLC, Prairie Village, KS (US)

(72) Inventor: Anne Royer, Prairie Village, KS (US)

( * ) Notice: Subject to any disclaimer, the term of this patent is extended or adjusted under 35 U.S.C. 154(b) by 0 days.

(21) Appl. No.: 16/375,383

(22) Filed: Apr. 4, 2019

(65) Prior Publication Data

US 2019/0223638 A1 Jul. 25, 2019

Related U.S. Application Data

(63) Continuation-in-part of application No. 15/946,521, filed on Apr. 5, 2018, now abandoned, which is a continuation-in-part of application No. 29/587,220, filed on Dec. 12, 2016, now Pat. No. Des. 821,123.

(51) Int. Cl.

| | |
|---|---|
| ***F16M 11/00*** | (2006.01) |
| ***A47G 19/08*** | (2006.01) |
| ***A47G 23/03*** | (2006.01) |

(52) U.S. Cl.

CPC ..... *A47G 19/08* (2013.01); *A47G 23/03* (2013.01)

(58) Field of Classification Search

CPC ..... A47G 19/08; A47G 23/03

USPC ..... 248/176.1, 346.01, 127, 146

See application file for complete search history.

(56) References Cited

U.S. PATENT DOCUMENTS

| | | | | |
|---|---|---|---|---|
| 2014/0346293 | A1* | 11/2014 | Qiu | A01K 5/0114 248/176.1 |
| 2017/0280675 | A1* | 10/2017 | MacNeil | A01K 7/005 |
| 2018/0014505 | A1* | 1/2018 | MacNeil | A01K 7/005 |
| 2018/0184616 | A1* | 7/2018 | Duran-Jimenez | A01K 5/0142 |

* cited by examiner

*Primary Examiner* — Todd M Epps

(74) *Attorney, Agent, or Firm* — Intellectual Property Center, LLC; Arthur K. Shaffer

(57) ABSTRACT

An improved tableware stand with a cylindrical base providing vertical elevation of an adapter for use to receive and retain tableware, the cylindrical base including a circumferential sidewall adapted for receiving a removable, reversable tableware adapter which securely engages the food service item with misaligned receiving structure. The receiving structure includes a plurality of concentric channels for securely receiving and retaining different sized, dimensioned, configured, or shaped food service items while providing a substantially planar platform elevated from an underlying support surface.

4 Claims, 5 Drawing Sheets

TABLEWARE STAND

CROSS-REFERENCE TO RELATED APPLICATION

This application is a continuation-in-part to the non-provisional application Ser. No. 15/946,241 filed on Apr. 5, 2018 claiming the benefit of the prior filed U.S. design patent application No. 29/587,220 filed on Dec. 12, 2016 which are incorporated herein by reference.

FIELD OF THE INVENTION

The present invention is broadly directed to an eating stand and more specifically, to an improved portable tableware stand with an adapter for securing varying dimensioned tableware including but not limited to dishes, plates, bowls, and drinkware.

BACKGROUND OF THE INVENTION

Elderly, disabled and impaired individuals have difficulty in eating. In some cases the distance between a user's mouth and the plated surface is too great and thus the tendency for food to fall off utensils before it is received within the user's mouth can be a problem. In addition, people often eat while not at a table. Some people eat sitting at a computer or watching a television, where the distance to the user's mouth is even greater. Eating or drinking without sufficient elevation, horizontal support and receiving structure for securing the food serving items can lead to spillage or accidents with the food.

A plate or other food service item used to rest or eat from can shift while moving. In addition, holding the plate or other food service item while away from a table or other raised platform may require use of both hands to hold the food service items which then limits the ability to use both hands for eating purposes. Over time, holding the food service item can become tiring or slip which can lead to food accidents. There is a need for securely raising and supporting a food service item while eating.

There are a variety of food service items, also generally referred to as tableware, each having a variety of configurations and dimensions. Tableware generally includes, but is not limited to, serverware, dinnerware and drinkware. While various types of plate and cup holders have been previously provided, most of merely present a receiving area of a fixed diameter which will not accommodate tableware items of widely differing sizes, as are commonly in commercial use today. Such single dimension holders are not adapted for use with a variety of sizes by the user to cause the same to accommodate either larger or smaller diameter containers than that for which they are initially intended. There is no generally uniform shape, size or dimension for a cup or plate holder, referred to herein generally as a food service item or tableware. Because there is no uniform dimensioned tableware, use of a food service tray, also referred to as a food server, which is configured for securely retaining a particular food service item is limited to a particular shape, dimension or design. Because there is no universal food service design, each having potentially different shapes, sizes and configurations, there is no widely adapted food server for use with varying shape, size or dimensioned food service item such as tableware, dinning ware, dishware, dishes, plates, bowls, cups, saucers, drinkware, etc. . . . Therefore, there is a need for a food server which is configured for securing a wide variety of food service items while eating apart from a table.

When resting a tableware item during movement or otherwise apart from a table, the tableware item is generally positioned on the lap of the user. Use of a standard dinning tray which may allow for resting of a tableware item, generally positions or maintains the tableware item in an uncomfortable position near the user's legs. Eating from a distance separating an average user's mouth and lap can create stress or strain upon the user's neck. In addition, the elevation gap can increase the likelihood of an accident as a result of food falling during movement between the tableware item and the user's mouth, for example. Therefore, there exists a need for a holder of a food service item which allows for increased vertical placement of the food service item nearer to the user's mouth.

Therefore, there is a need for an improved tableware stand which secures a variety of dimensioned, size or shaped tableware while eating at or apart from a table.

SUMMARY OF THE INVENTION

The present invention is directed to an improved tableware stand adapted for raising and receiving a food (or drink) service item like a cup, bowl, plate, saucer, drinkware, etc., presenting an arcuate shaped surface (also referred to herein as a well) and having a raised, circular base opposite the well for use as part of an eating experience. The improved tableware stand generally includes an elevated base with a plurality of convex openings spaced along a sidewall. The elevated base provides vertical elevation during use while presenting a substantially planar surface with a circular opening adapted for receiving the removable, reversable tableware adapter which securely engages the food service item.

In one embodiment, the present invention, an improved tableware stand, is configured for use in securing a first and a second tableware item each having a base and a curved surface extending outwardly towards a lip, the improved tableware stand comprising an elevated spacer with a sidewall extending from a bottom to an upper ledge, a depending lip extending inwardly from said upper ledge, an adapter having a first side opposite a second side with a central opening extending therethrough, said adapter adapted for engagement by said depending lip, said first side having receiving structure for receiving the first tableware item, said second side having receiving structure for receiving the second tableware item, wherein said first side receiving structure receives the base of the first tableware item and said second side receiving structure receives the base of the second tableware item, and an outer projection extending outwardly from said adapter for engagement by said depending lip.

In another embodiment, the receiving structure further comprises a first ridge separated from a second ridge by a radial channel. In another embodiment, the improved tableware stand further comprises a plurality of convex ridges positioned along said sidewall.

The improved tableware stand generally presents plural concentric channels for securely receiving and retaining different sized, dimensioned, configured, or shaped food service items while providing a substantially planar platform elevated from an underlying support surface, such as a table, cart, tray, or user's lap. The adapter includes a first side and a second side, and in one embodiment, each side presents at least one circular channel extending between a pair of ridges adapted for engagement with the tableware base, a central opening extending between both the first and second sides.

These and various other advantages and features of novelty which characterize the present invention are pointed out with particularity in the claims annexed hereto and forming a part hereof. However, for a better understanding of the invention, its advantages and objects obtained by its use, reference should be made to the drawings which form a further part hereof, and to the accompanying descriptive matter, in which there is illustrated and de scribed preferred embodiments of the present invention.

DETAILED DESCRIPTION OF THE INVENTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
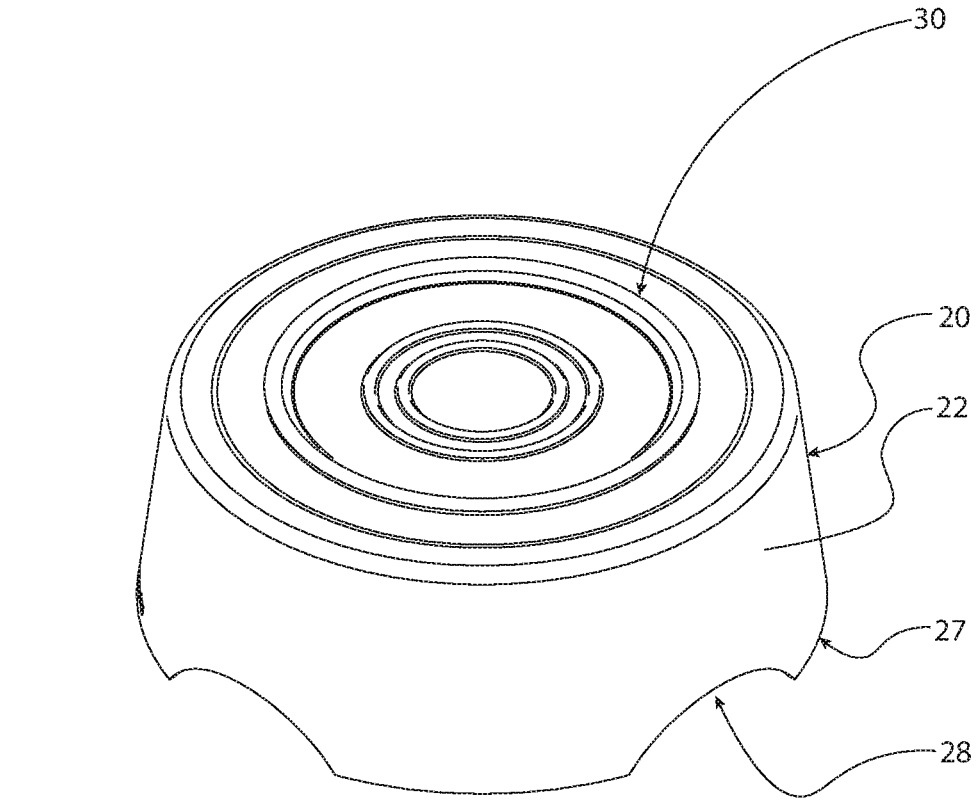
FIG. 1 illustrate a front perspective of an exemplary embodiment of the improved tableware stand.

Referring to the drawings in more detail, the reference numeral 10 generally refers to an embodiment of the present invention, improved tableware stand (also referred to as the "device") according to the embodiment illustrated in FIG. 1 which is useful for securely receiving a tableware or dining item, like a plate, bowl, dish, cup or saucer during a dining related activity and for maintaining the dining item in an elevated, generally planar orientation. The improved tableware stand 10 includes an adapter 30 and an elevated spacer 20. The elevated spacer 20 is configured for receiving the adapter 30 and may have a cylindrical, rectangular or other polygonal shape which is configured for receipt of the adapter 30 and includes a sidewall 22 extending from an arcuate opening 24 to a bottom 27 with a plurality of convex ridges 28 spaced along the sidewall 22. In the depicted embodiment, the sidewall 22 is circumferential.

The embodiment of the tableware 2 depicted in FIGS. 3-7 is generally configured for eating and includes an arcuate circular surface with a lip 5 extending radially from a downwardly depending well 4 opposite a generally circular base 3 which supports and raises the tableware 2 from the underlying improved tableware stand 10.

Figure 2:
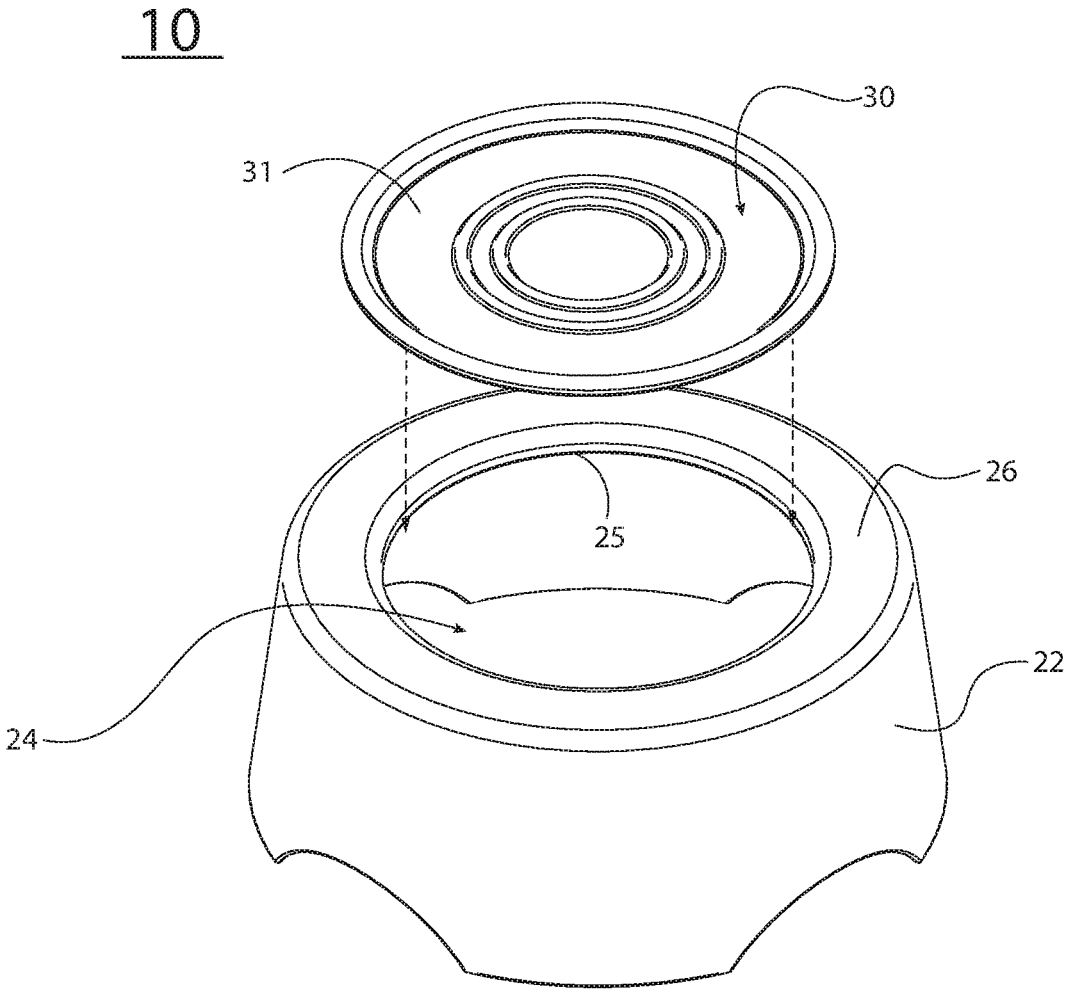
FIG. 2 is a front perspective of the tableware stand with the adapter positioned above the spacer in accordance with the embodiment illustrated in FIG. 1.
Figure 3:
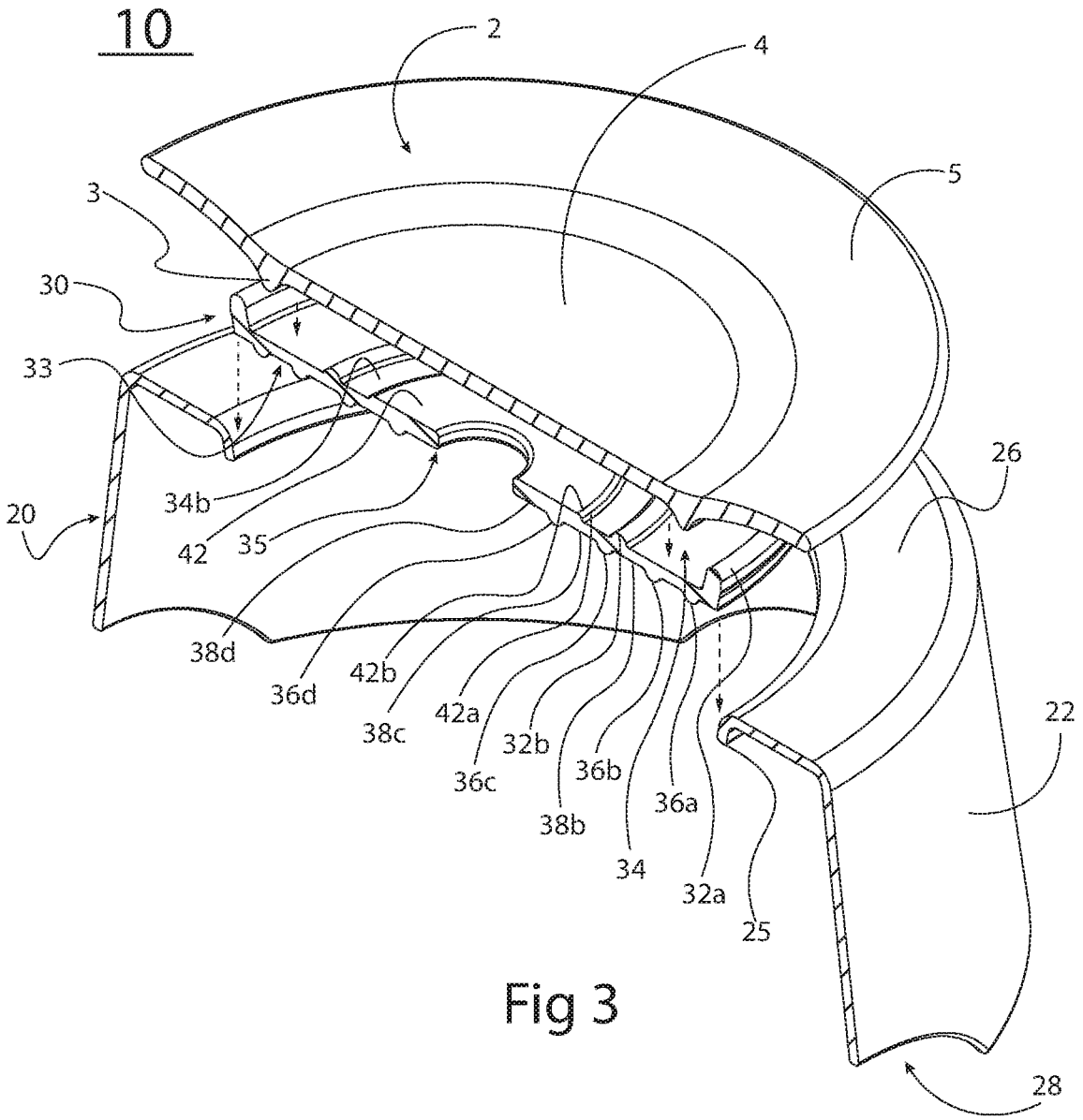
FIG. 3 is a cross-sectional exploded view of an exemplary dish adapted for receipt by the improved tableware stand while positioned above the spacer in accordance with the embodiment illustrated in FIG. 1.
Figure 6:
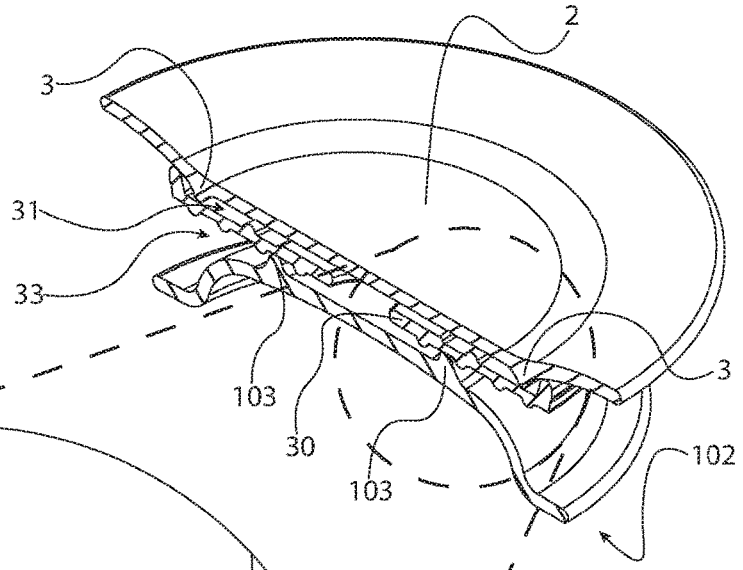
FIG. 6 is a front perspective, cross-sectional view of an embodiment of the improved tableware stand in receipt of two-dishes on opposite sides.
Figure 7:
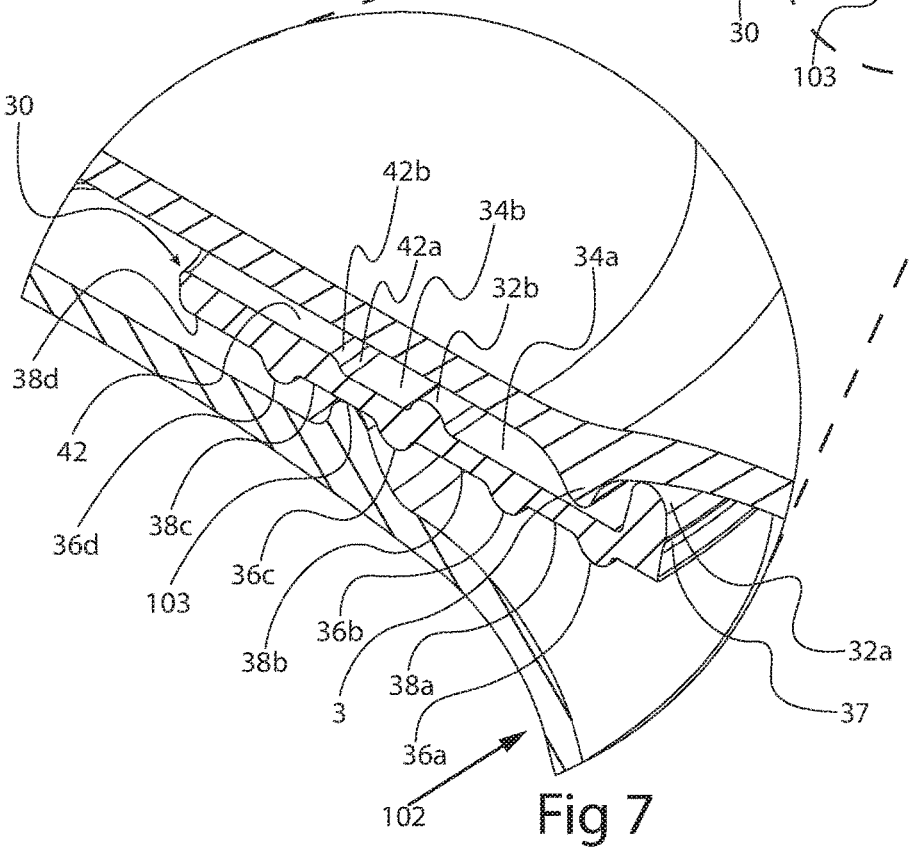
FIG. 7 is a magnified, fragmented view of the illustrated embodiment of the improved tableware stand according to the embodiment illustrated in FIG. 6.

The arcuate opening 24 illustrated in FIG. 2 presents an elevated support surface which has an upper ledge 26 which extends radially from the sidewall 22 to a depending lip 25. The upper ledge 26 generally presents a substantially planar support structure with an arcuate depending lip 25 for aligned receipt of the adapter 30 within the arcuate opening 24. Alternatively, the upper ledge 26 may provide the planar support structure for overlying receipt and support of the adapter 30 in a substantially planar orientation. The adapter 30 has receiving structure for receiving a plurality of tableware items, which include at least a first tableware item 2 and a second tableware item 102, the base 3 of the first tableware item 2 received by the first side 31 and the second base 103 of the second tableware item 102 received by the second side 33 as illustrated in FIGS. 6-7. Alternatively, the adapter 30 may be configured to provide for multiple receiving structures on the first side 31 for receiving the first and second tableware items 2, 102. However, in the depicted embodiment the base 3 and the second base 103 have different radial configurations for off-set receipt by opposing sides of the adapter 30.

The convex ridges 28 presents an arcuate curve which extends from the bottom 27 along the sidewall 22 and presents a hand relief surface for gripping the device 10. The arcuate curve associated with the convex ridge 28 is generally sufficiently shaped to be beneficial when resting the improved tableware stand 10 on the lap or leg of a user (not shown).

Figures 4, 5:
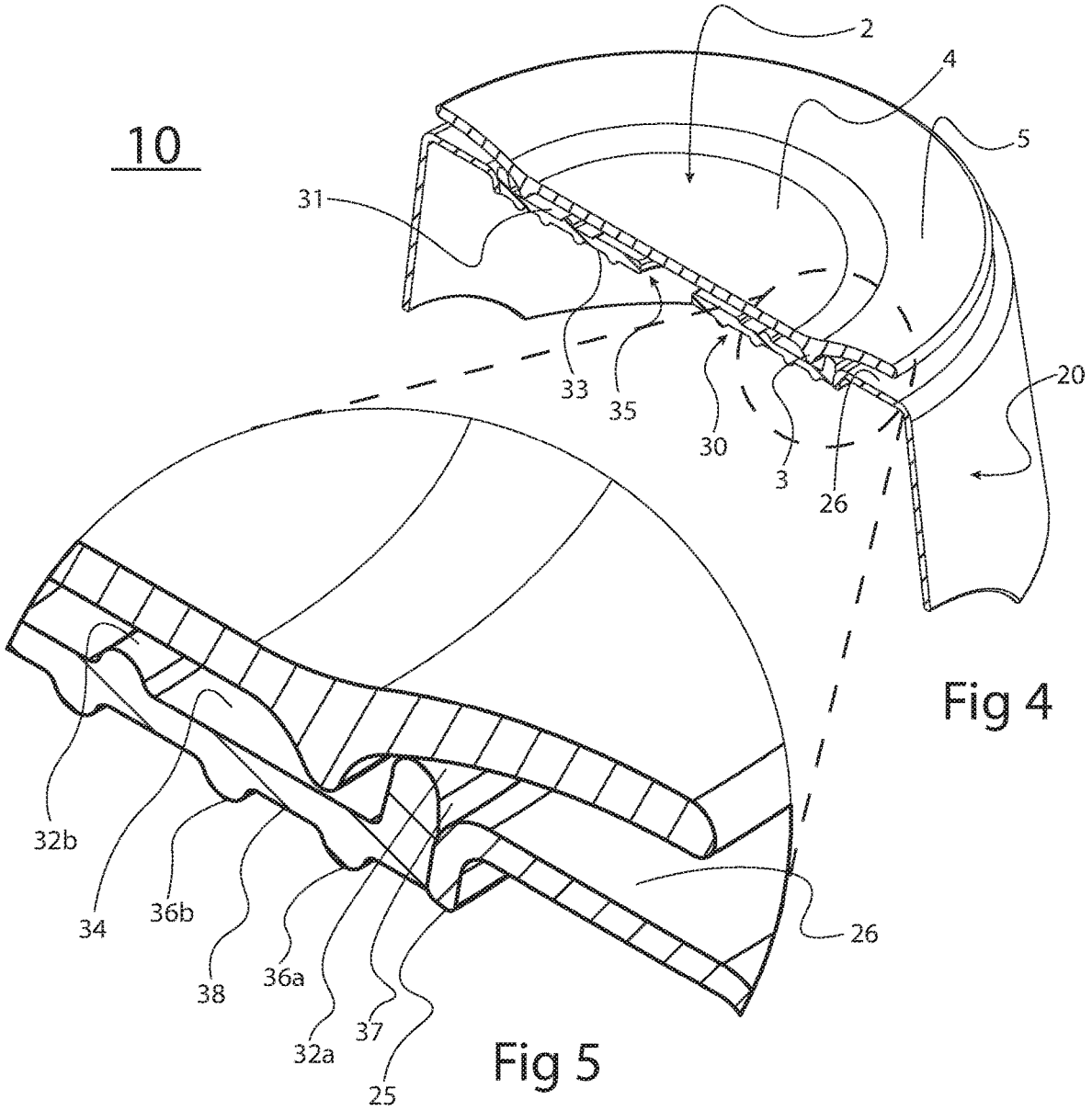
FIG. 4 is a front perspective, cross-sectional view of the dish received by the improved tableware stand in accordance with the embodiment depicted in FIG. 1.
FIG. 5 is a magnified, fragmented view of the illustrated embodiment in FIG. 4.

As further depicted in FIGS. 5-7, the adapter 30 is removable and reversable within the arcuate opening 24. In the illustrated embodiment the adapter 30 is generally circular and has a first side 31 opposite a second side 33 with a central opening 35 extending therethrough. The first side 31 of the adapter 30 also includes a first upper ridge **32*a* spaced from a second upper ridge 32*b* by a first upper radial channel 34. The second side 33 includes a first lower ridge 36*a* spaced from a second lower ridge 36*b* by a first lower radial channel 38. Generally, the first side 31 is configured differently from the second side 33 with the first upper radial channel 34 being misaligned from the first lower radial channel 38 allowing the adapter 30 to be used with a variety of tableware 2 each having different configurations of bases 3 depending on which side of the adapter 30 is facing upward for receipt of the desired tableware 2** such as, but not limited to, a dish, plate, cup or bowl.

The depending lip 25 extends inwardly from the upper ledge 26 for engagement by the first upper ridge **32*a*. As indicated in FIG. 5, the first upper ridge 32*a* includes a circular projection 37 which extends outwardly from the adapter 30 for engagement by the downwardly depending lip 25**.

Additionally, as further illustrated in FIG. 5 the first upper ridge **32*a* extends a greater distance from the first upper radial channel 34 in relation to the second upper ridge 32*b*, the first upper ridge 32*a* presenting an upward projection between the base 3 and the lip 5 for receipt of the plate 2 within the first upper radial channel 34 associated with the first side 31 of the adapter 30. In addition, as further illustrated in FIG. 3, a central radial spacer 42 encircles the central opening 35 and presents a plurality of ridges 42*a*, 42*b* which present a second upper radial channel 34*b* for receipt of different dimensioned tableware 2**.

A plurality of lower radial channels (a second lower radial channel **38*b*, a third lower radial channel 38*c*, a lower central channel 38*d*) are presented by a plurality of lower ridges (a third lower ridge 36*c*, a fourth lower ridge 36*d*) each lower radial channel extending radially from the central opening 35 towards the first lower ridge 36***b*. In the illustrated embodiment, the second lower radial channel 38*b* is presented between the second lower ridge 36*b* and the third lower ridge 36*c*, the third lower radial channel 38*c* is presented between the third lower ridge 36*c* and the fourth lower ridge 36*d*, a lower central channel 38*d* extending between the fourth lower ridge 36*d* and the central opening 35. The plurality of radial channels associated with the second side 33 allow the adapter 30 to receive and support various dimensioned tableware configurations in addition to those which are provided by the first side 31 allowing the improved tableware stand 10 to be used with a larger number of tableware configurations which are not currently provided for.

It is to be understood that while certain forms of the present invention have been illustrated and described herein, one skilled in the art would clearly recognize that it is not to be limited to the specific forms or arrangement of parts described and shown but only by the claims appended hereto.

What is claimed and desired to be secured by Letters Patent:

1. An improved tableware stand for use in securing first and second tableware items each having a base and a curved surface extending outwardly towards a lip, the improved tableware stand comprising:

an elevated spacer with a sidewall which extends from a bottom to an upper ledge;

a depending lip which extends from said upper ledge;

an adapter having a first side opposite a second side with a central opening which extends therethrough;

said first side having a first receiving structure for receiving the first tableware item and a second receiving structure for receiving the second tableware item; and a circular projection which extends outwardly from said adapter for engagement by said depending lip.

2. The improved tableware stand according to claim 1, said second side having a second side receiving structure for receiving the second tableware item, wherein said second side receiving structure receives the base of the second tableware item.

3. The improved tableware stand according to claim 1 wherein said first receiving structure further comprises a first ridge separated from a second ridge by a radial channel.

4. The improved tableware stand according to claim 1 wherein further comprising a plurality of convex ridges positioned along said sidewall.

* * * * *